US008496814B2

(12) United States Patent
Kent

(10) Patent No.: US 8,496,814 B2
(45) Date of Patent: Jul. 30, 2013

(54) PARTITIONED SEPARATOR WATER TREATMENT SYSTEM WITH UPFLOW FILTER

(76) Inventor: Zachariha Kent, Oceanside, CA (US)

( * ) Notice: Subject to any disclaimer, the term of this patent is extended or adjusted under 35 U.S.C. 154(b) by 593 days.

(21) Appl. No.: 12/701,689

(22) Filed: Feb. 8, 2010

(65) Prior Publication Data

US 2011/0192773 A1 Aug. 11, 2011

(51) Int. Cl.
*C02F 1/00* (2006.01)
*E02B 15/00* (2006.01)

(52) U.S. Cl.
USPC ..... 210/170.03; 210/123; 210/232; 210/254; 210/256; 210/519; 210/521; 210/532.1; 210/747.2; 210/801

(58) Field of Classification Search
None
See application file for complete search history.

(56) References Cited

U.S. PATENT DOCUMENTS 8,034,234 B2 * 10/2011 Happel ..... 210/121
2010/0032363 A1 * 2/2010 Happel ..... 210/242.1

* cited by examiner

*Primary Examiner* — Dirk Bass
(74) *Attorney, Agent, or Firm* — Steven W. Webb

(57) ABSTRACT

A system designed to control and filter runoff water in storm drains is presented. Drain water frequently carries trash, organic matter, suspended solids, hydrocarbons, metals, nutrients and bacteria collected from streets and parking lots into a storm drain inlet, which enters storm water drain pipe systems.

The present invention supplies a series of baffle boxes inserted in the drain water stream with a final box possessing an upflow filter and a hydrocarbon absorbing boom. The system can also support a storm flow bypass that directs high-flow storm runoff water directly to the outlet to protect the filter system.

3 Claims, 2 Drawing Sheets

PARTITIONED SEPARATOR WATER TREATMENT SYSTEM WITH UPFLOW FILTER

FIELD OF THE INVENTION

This invention relates to the fields of water filtration systems and storm water control systems.

BACKGROUND OF THE INVENTION

The present invention is designed to control and filter run-off water in storm drains. Drain water frequently carries trash, organic matter, suspended solids, hydrocarbons, metals, nutrients and bacteria is collected from paved surfaces and other areas into a storm drain inlet, then sent into a storm water drain pipe system. Drain water often carries oil collected from the streets.

Various water bodies including ponds, rivers, and oceans can tolerate a certain amount of pollutant loading, but the amount allowed to flow into these collection areas should be minimized. The present invention is a in-line storm water drain filter system having with a series of separation chambers for removing larger material followed by an upflow filter for smaller and dissolved material. The filter box is installed within a storm water drain pipe; this pipe directs drain water through the separation chambers and up flow filter to the storm water drain water passing through an outfall into a lake, pond or retention area. There is an upflow filter between the separation chambers and the outflow to address collection of fine particulates and organics. A hydrocarbon collecting boom in a cage is placed at the last separation baffle on the influent side to absorb hydrocarbons.

SUMMARY OF THE INVENTION

The inline partitioned separator and upflow filter system is installed inline with the drain water flow path, and can be buried underground with access ports. The filter system includes a housing having an inlet and an outlet and a plurality of separation chambers formed therein. The separation chambers collect various densities of sediment for later cleaning. A housing cover allows access into the housing and a plurality of separation chambers and media cages.

An oil collection boom is removably mounted on one or more of the baffles near the outlet for collecting hydrocarbons in the drain water entering the system.

The separation chambers closest to the outflow are each equipped with an up flow filter. The up flow filter has two main components: the filter housing and the filter media. The filter housing is constructed of a cage that holds the media. It has top doors that open to allow the media to be changed out.

The media is a filter that removes fine TSS, nutrients, metals, bacteria, and emulsified hydrocarbons from the drain water as it flows upward through the last separation chamber.

One of the unique features of this system is that fall between the inflow and outflow pipes is not necessary as with downward flow systems. The internal weir, located on the side of the up flow filter opposite of the outflow pipe allows water pressure to build behind it which drives water through the up flow filter.

A standard 3 chambered separator works well enough to provide the necessary drain water pretreatment to prevent larger particles and solid pollutants from prematurely clogging the up flow filter.

DETAILED DESCRIPTION OF THE INVENTION

Figure 1:
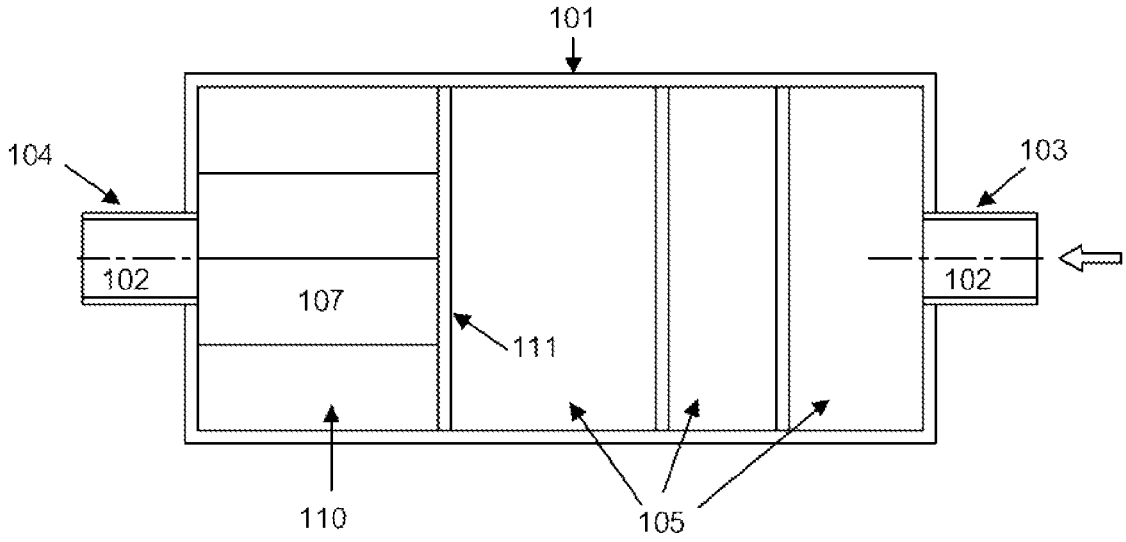
FIG. 1. Top view of the invention

The invention consists of a rectangular box 101 inserted in the flow stream of a drain 102 with an inflow end 103 and an outflow end 104. The box 101 is divided into a plurality of separation chamber compartments 105 with no tops, the tops of the compartments 105 open to the air.

Figure 2:
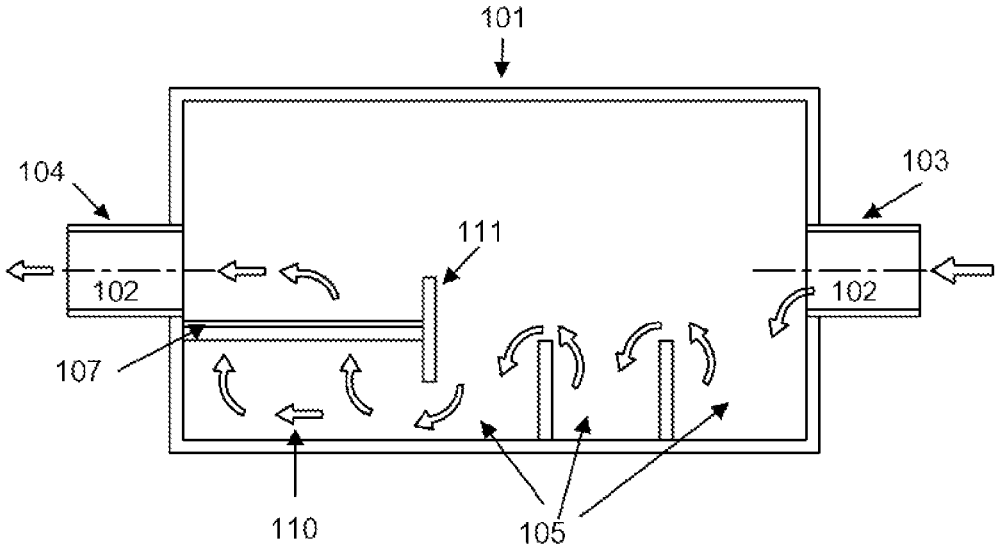
FIG. 2. Side view of the Low Flow configuration of the invention
Figure 3:
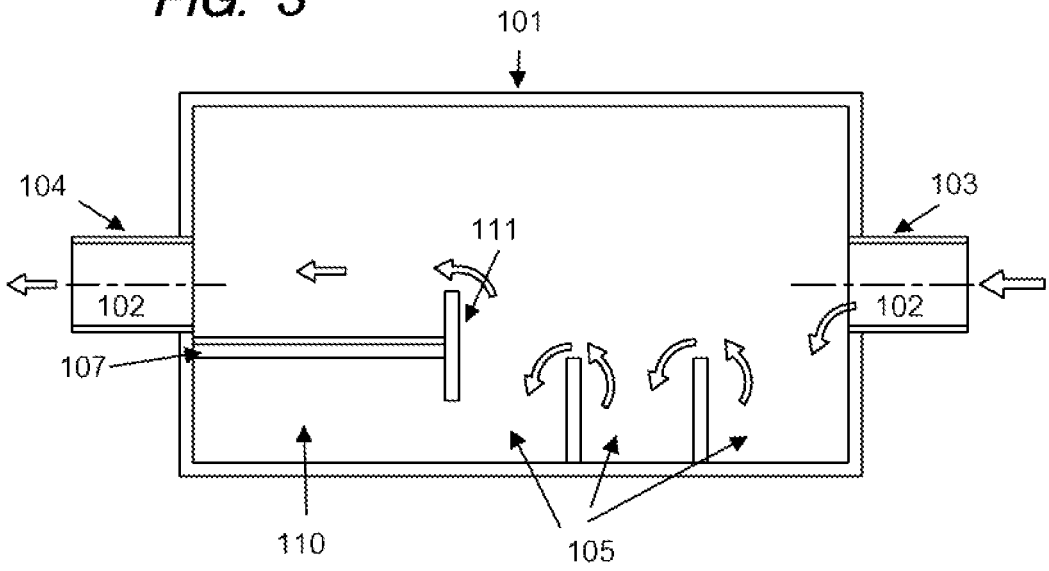
FIG. 3. Side view of the Storm Flow configuration of the invention

The compartments 105 are designed to trap sediment as it flows from the inflow 103, as shown in FIG. 1, FIG. 2, and FIG. 3. Drain water enters the box 101 at the inflow 103 and flows over the tops of the plurality of compartments 105 allowing sediment and solid pollutants to be trapped in the compartments 105 to be later removed.

Figure 4:
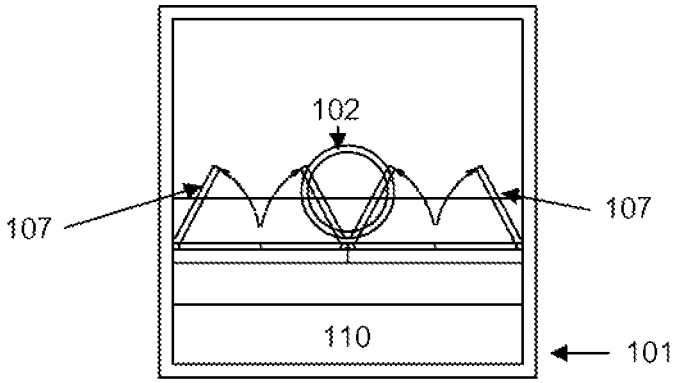
FIG. 4. Front View of the invention showing open filters

In the preferred embodiment, the last baffled compartment 110 possesses a hydrocarbon-absorbing boom 111 and an upflow filter 107. Water rising from the last compartment 110 leaves through the outflow end 104 due to water pressure formed in the last compartment 110 and is forced up through the filter 107, which is designed to remove fine and dissolved pollutants from the drain water. FIG. 4 shows an end view of the invention with the four filters folded up for cleaning.

An alternate embodiment uses a float and a gate to direct all overflow water over the last baffle when drain water levels are high, closing the last separation chamber 110. This effectively bypasses the media filter 107 during storm conditions but still allows the absorbent boom 111 to be effective.

The apparatus and methods described are the preferred and alternate embodiments of this invention, but other methods are possible and are within the contemplation of this patent.

What is claimed is:

1. a baffle box drain system, comprised of a rectangular box inserted in the flow stream of a drain, the drain possessing an inflow end and an outflow end, the rectangular box divided into a plurality of separation chamber compartments, each compartment without a top, the compartment tops below the level of the inflow end and outflow end of the rectangular box, the drain and rectangular box situated such that water enters the box at the inflow end and flows over the tops of the plurality of compartments allowing sediment and solid pollutants to be trapped in the compartments, the last compartment at the outflow end possessing a baffle, an absorbent boom, and a horizontal upflow filter, the baffle a solid vertical barrier across the rectangular box with a bottom opening leading into the last compartment and a top that extends in height above the tops of the other compartments, said height selected to force water flow below the baffle without restricting the flow rate of water through the outflow end during flooding, the baffle attached in its middle to the upflow filter, the length of the baffle extending below the attachment point to the upflow filter selected to balance the flow rate of drain water into the last compartment through the bottom opening with the flow rate of water through the upflow filter, the upflow filter situated such that water rising from the last compartment leaves through the outflow end of the drain due to water pressure formed in the last compartment, said water forced up through the upflow filter, said upflow filter designed to remove fine and dissolved pollutants from the drain water.

2. A baffle box drain system as in claim 1 where the absorbent boom is designed to absorb hydrocarbons dissolved in drain water.

3. A baffle box drain system as in claim 1, where the length of the baffle from the bottom of the up flow filter to the bottom of the baffle is equal to or greater than the length of the baffle from the top of the up flow filter to the top of the baffle, said baffle length below the up flow filter creating a longer water flow path to increase sedimentation and prevent upflow filter clogging.

* * * * *